US007213932B1

(12) United States Patent
Savicki, Jr.

(10) Patent No.: US 7,213,932 B1
(45) Date of Patent: May 8, 2007

(54) ELECTRICAL DEVICE WITH LAMP MODULE

(75) Inventor: Gerald R. Savicki, Jr., Syracuse, NY (US)

(73) Assignee: Pass & Seymour, Inc., Syracuse, CA (US)

( * ) Notice: Subject to any disclaimer, the term of this patent is extended or adjusted under 35 U.S.C. 154(b) by 82 days.

(21) Appl. No.: 10/726,173

(22) Filed: Dec. 2, 2003

Related U.S. Application Data

(60) Provisional application No. 60/439,370, filed on Jan. 9, 2003.

(51) Int. Cl.
*F21V 33/00* (2006.01)

(52) U.S. Cl. ..... 362/95; 362/800; 200/317

(58) Field of Classification Search ..... 362/85, 362/95, 800; 200/310, 313, 317; 439/490
See application file for complete search history.

(56) References Cited

U.S. PATENT DOCUMENTS 3,265,888 A * 8/1966 Adolphson, Jr. ..... 362/95
3,588,489 A * 6/1971 Gaines ..... 362/95
3,895,225 A * 7/1975 Prior ..... 362/95
4,667,073 A * 5/1987 Osika ..... 200/317
5,146,385 A * 9/1992 Misencik ..... 361/56
5,413,501 A * 5/1995 Munn ..... 439/535
5,485,356 A * 1/1996 Nguyen ..... 362/95
6,010,228 A * 1/2000 Blackman et al. ..... 362/95
6,805,469 B1 * 10/2004 Barton ..... 362/365
6,883,927 B2 * 4/2005 Cunningham et al. ..... 362/95
7,118,235 B2 10/2006 Barton

* cited by examiner

*Primary Examiner*—Sandra O'Shea
*Assistant Examiner*—Peggy A. Neils
(74) *Attorney, Agent, or Firm*—Daniel P. Malley; Bond, Schoeneck & King PLLC

(57) ABSTRACT

An electrical wiring device for use in an electric circuit. The electrical wiring device includes a device housing and at least one switch disposed within the device housing. The at least one switch includes at least one terminal member configured to be coupled to the electric circuit to thereby energize the electrical device when coupled. The electrical wiring device further includes a lamp receptacle formed in the device housing, the lamp receptacle including a contact element that is electrically coupled to the at least one terminal member and a lamp module including a circuit contact member. The lamp module having a lamp module form factor that is configured to be inserted into the lamp receptacle such that the lamp circuit contact member engages the contact element to thereby establish electrical connectivity between the lamp light module and the at least one terminal member, the lamp module also being removable from the lamp receptacle to thereby disengage the circuit contact member from the contact element.

20 Claims, 4 Drawing Sheets

ELECTRICAL DEVICE WITH LAMP MODULE

This application claims the benefit of priority under 35 U.S.C. § 119(e) of Provisional U.S. Patent Application Ser. No. 60/439,370 filed on 9 Jan. 2003, the content of which is relied upon and incorporated herein by reference in its entirety.

FIELD OF THE INVENTION

The present invention relates to an electrical wiring device and more particularly to an electrical wiring device suitable for commercial and residential use.

BACKGROUND OF THE INVENTION

Upon entering a darkened room a person unfamiliar with the layout of the room must typically locate a wall switch to turn on the lights. Searching for a wall switch in a darkened room often requires navigating around objects such as tables and chairs. Such searching is hazardous and unsafe for those involved. Thus, there is a need for an electrical wiring device that provides a visual indication as to its location in a darkened room. One approach to solving this problem includes providing a wall mounted illumination device. Typically, a wall mounted illumination device for use in residential or commercial applications includes a conventional electrical wiring device that incorporates dedicated illumination circuitry and a permanently mounted light source.

One draw back to these devices is that once installed they are not reconfigurable from a non-illuminated device to an illuminated device. For example, if a wall mounted, non-illuminated electrical wiring device is installed and it is later determined that an illuminated electrical wiring device is required, the non-illuminated electrical wiring device must be removed and an illuminated electrical wiring device installed thereby increasing the cost of the electrical installation. Thus, there is a need for an electrical wiring device that is reconfigurable, after installation, from a non-illuminated electrical wiring device to an illuminated electrical wiring device, and from an illuminated electrical wiring device to a non-illuminated electrical wiring device.

SUMMARY OF THE INVENTION

In one embodiment, the present invention includes an electrical wiring device for use in an electric circuit. The electrical wiring device includes a device housing and at least one switch disposed within the device housing. The at least one switch includes at least one terminal member configured to be coupled to the electric circuit to thereby energize the electrical device when coupled. The electrical wiring device further includes a lamp receptacle formed in the device housing, the lamp receptacle including a contact element that is electrically coupled to the at least one terminal member and a lamp module including a circuit contact member, the lamp module having a lamp module form factor that is configured to be inserted into the lamp receptacle such that the circuit contact member engages the contact element to thereby establish electrical connectivity between the lamp module and the at least one terminal member, the lamp module also being removable from the lamp receptacle to thereby disengage the circuit contact member from the contact element.

In another embodiment, the present invention includes a method of installing an electrical wiring device. The method of installing an electrical wiring device includes the step of providing electrical wiring device for use in an electric circuit. The wiring device includes at least one switch disposed within the device housing. The at least one switch includes at least one terminal member configured to be coupled to the electric circuit to thereby energize the electrical device when coupled. The wiring device also includes a lamp receptacle formed in the device housing. The lamp receptacle includes a contact element that is electrically coupled to the at least one terminal member. The method further includes the step of providing a lamp module having a form factor that is configured to be inserted into the lamp receptacle, whereby the circuit contact member engages the contact element to establish electrical connectivity between the lamp module and the at least one terminal member. The method further includes the step of inserting the lamp module into the lamp receptacle such that the circuit contact member engages the contact element to thereby establish electrical connectivity between the lamp module and the at least one terminal member.

In yet another embodiment, the present invention includes a method of making an electrical wiring device for use in an electric circuit. The method of making an electrical wiring device for use in an electric circuit includes the step of providing a device housing. The device housing has a lamp receptacle formed therein, the lamp receptacle including a receptacle contact element. The method further includes the step of disposing at least one wiring device within the device housing. The at least one wiring device includes at least one switch. The at least one switch includes at least one terminal member configured to be coupled to the electric circuit. The at least one terminal member is configured to engage the receptacle contact element when the at least one wiring device is disposed within the device housing. The method further includes the step of providing a lamp module having a form factor that is configured to be inserted into the lamp receptacle, having a circuit contact member whereby the circuit contact member engages the contact element to establish electrical connectivity between the lamp module and the at least one terminal member. The method further includes the step of inserting the lamp module into the lamp receptacle such that the circuit contact member engages the contact element to thereby establish electrical connectivity between the lamp module and the at least one terminal member.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

BRIEF DESCRIPTION OF THE DRAWINGS

FIG. 2 is an exploded view of the electrical wiring device shown in FIG. 1;

DETAILED DESCRIPTION OF THE PREFERRED EMBODIMENTS

Figure 1:
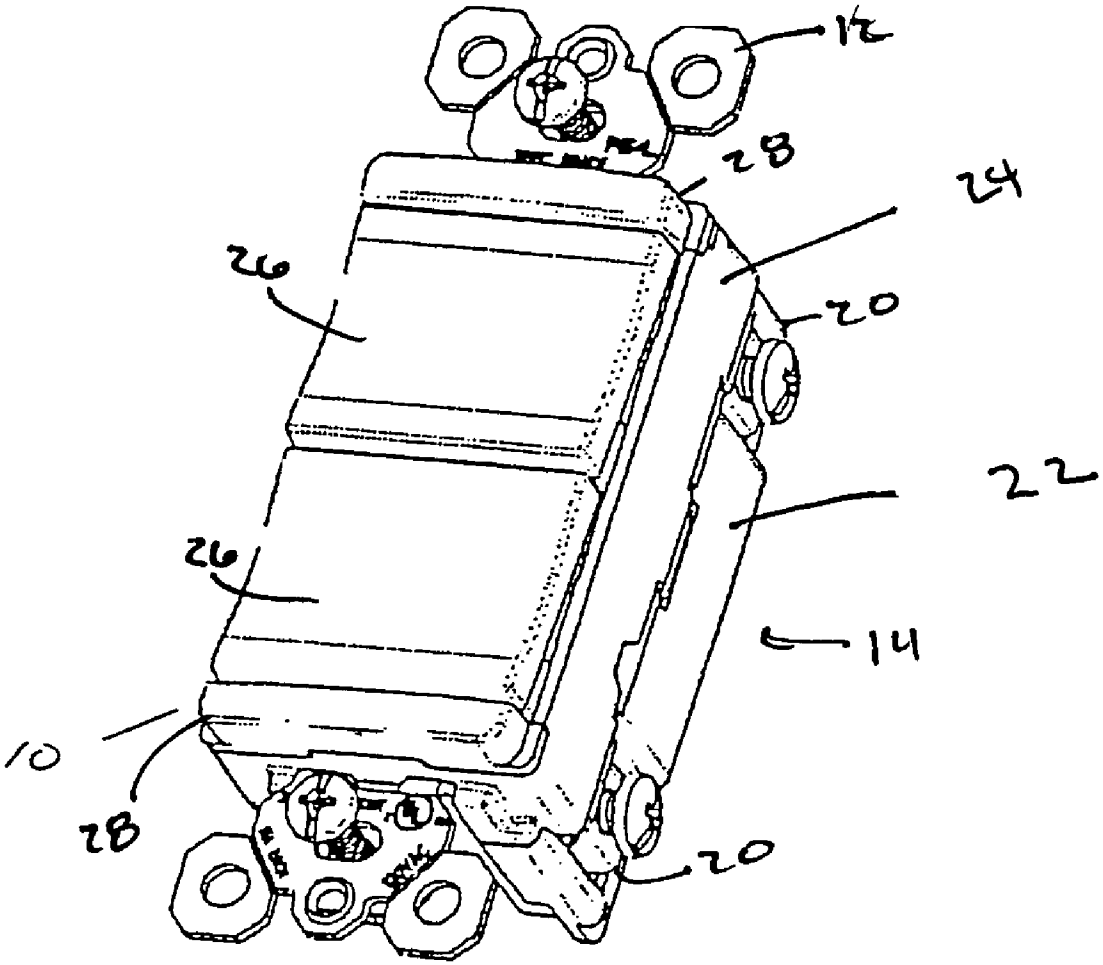
FIG. 1 is a perspective view of an one embodiment of the electrical wiring device of the present invention.

Reference will now be made in detail to the present embodiments of the invention, examples of which are illustrated in the accompanying drawings. Whenever possible, the same reference numerals will be used throughout the drawings to refer to the same or like parts.

One embodiment of the electrical device of the present invention is shown in FIG. 1 and is designated generally throughout by the reference numeral 10. The electrical wiring device 10 includes a ground strap 12 and a housing 14. The housing 14 is configured for installation in an electrical wall box. The ground strap 12 is configured to attach the electrical wiring device 10 to the wall box. Typically screws are used to attach the ground strap 12 to the wall box. The housing 14 includes a body 22 and frame 24. Both the body 22 and the frame 24 are made from a non-electrically conductive material, such as, for example plastic and may be made by injection molding, although those skilled in the art of making electrical wiring devices will readily appreciate that other manufacturing processes may be used. The body 22 and frame 24 are configured to engage one another thereby forming the housing 14. The body 22 is configured to receive a plurality of terminals 20, the body 22 electrically isolates the terminals from one another. The frame 24 is configured to receive at least one switch paddle 26. In the embodiment shown in FIG. 1, the body 22 is configured to receive two switch paddles 26.

A better understanding of the embodiment of the present invention illustrated in FIG. 1 may be gained by considering FIG. 2 which is an exploded view of the electrical device 10 shown in FIG. 1.

As shown in FIG. 2, the electrical device 10 of the present invention includes two single pole switches and a lamp module. The electrical device 10 is sized to fit in a conventional wall box (not shown). The body 22 is configured to receive five terminals 20*a*, 20*b*, 20*c*, 20*d*, 20*e*. The terminals 20*a*, 20*b*, 20*c*, 20*d*, 20*e* are held apart from one another and are electrically isolated from one anther. The plurality of terminals 20*a*, 20*b*, 20*c*, 20*d*, 20*e* includes a first stationary terminal 20*a*, a first pivot terminal 20*b*, a second stationary terminal 20*c* and a second pivot terminal 20*d* and a lamp terminal 20*e*. The first stationary terminal 20*a* and the first pivot terminal 20*b* are associated with the first single pole switch and the second stationary terminal 20*c* and the second pivot terminal 20*d* are associated with the second single pole switch. Each of the 20*a*, 20*b*, 20*c*, 20*d*, 20*e* terminals is configured to receive the end of an electrically conductive wire (not shown). The electrically conductive wires establish an electrical circuit. The electrically conductive wires may include at least one line wire and a neutral wire, or at least one line wire and a ground wire, having a power source there between. Alternatively or in addition, the electrically conductive wires may include at least one load wire. If a load terminal 20 is provided, electrical device 10 operates to selectively establish or break electrical connectivity between the power source and the remote load. The frame 24 is configured to engage the body 22 in a predetermined manner to form a unitary body.

The frame 24 is configured to receive two switch paddles 26 and two blanks 28. The floor 30 of the of the frame 24 defines two openings 42 which allow the switch paddles 26 to engage the moveable three way 36 of their respective switch.

The switch paddles 26 are made from a non-electrically conductive material, such as, for example plastic and may be made by injection molding. Each switch paddle 26 is configured to receive one end of the moveable three way 36.

The electrical device 10 further includes a first clip 38 and a second clip 40 mounted to the frame 24. The first clip 38 and the second clip 40 are electrical conductors. Both the first clip 38 and the second clip 40 are coupled to the frame 24 and are spaced apart from one another and are thereby electrically isolated from one another. In the embodiment shown, the first clip 38 and the second clip 40 are metallic strips. The first clip 38 and the second clip 40 are positioned over openings 42 in the floor 30 of the frame 24. The openings 42 allow contacts 44 extending from the second stationary terminal 20*c* to engage the first clip 38 and from the second pivot terminal 20*d* to engage the second clip 40, thereby establishing electrical conductivity between the respective terminals and clips. One end 46 of the first clip 38 is configured as an electrical contact for engagement with a complementary electrical contact 54 of a lamp module 50. One end 48 of the second clip 40 is configured as an electrical contact for engagement with an a complementary electrical contact 56 of the lamp module 50.

Figure 7:
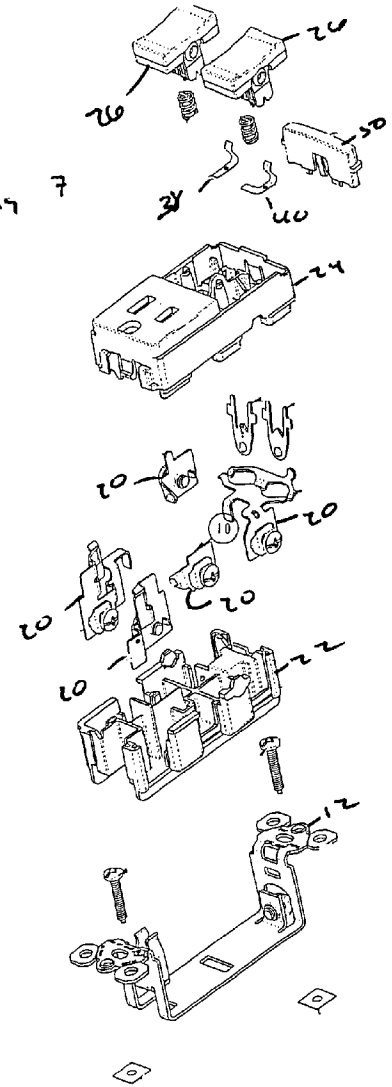
FIG. 7 is an exploded view of an alternative embodiment of the electrical device shown in FIG. 6.

The electrical device 10 may further include a removably engageable lamp module 50. One embodiment of a lamp module 50 is shown in FIG. 7. The lamp module 50 is configured to replace one of the blanks 28. The lamp module 50 includes a printed circuit board 52. The printed circuit board 52 includes two electrical contacts 54, 56, electrical control circuitry 58 and a light source 60, such as, for example one or more light emitting diodes. The lamp module 50 further includes a cover 62. The printed circuit board 52 is coupled to the cover 62 and is at least partially disposed within an interior volume of the cover 62. The electrical contacts 54, 56 are located so as to engage the first and second clips 38, 40 when the lamp module 50 replaces one of the blanks 28. The engagement of the electrical contacts 54, 56 with the first and second clips 38, 40 establishes electrical conductivity there between and allows electrical power to be supplied to the lamp module 50. The lamp module 50 is configured to emit light constantly when the electrical device 10 is installed and the second paddle switch 26 breaks electrical connectivity between the second stationary terminal 20*c* and second pivot terminal 20*d*, that is, when stationary terminal 20*c* is not providing power to a load. Lamp module 50 thus operates as a locator for electrical wiring device 10. A locator can have several benefits, for example, assisting with the location of the electrical wiring device in a darkened room.

In an alternate embodiment, clips 38 and 40 can be electrically connected to other combinations of terminals 20. Electrical connection of clips 38 and 40 to a line wire terminal and a neutral wire terminal causes lamp module 50 to operate as a power-on indicator (or live indicator), that is, lamp module 50 emits light when electrical power has been coupled from the electric circuit to wiring device 10. Alternatively, electrical connection of clips 38 and 40 to a line wire terminal and a ground wire terminal causes lamp module 50 to operate as a ground presence detector, in which case lamp module 50 emits light if a ground conductor is electrically connected to the ground terminal of wiring device 10. Alternatively, electrical connection of clips 38 and 40 to a load terminal and a neutral terminal causes lamp module 50 to operate as a remote use indicator, in which case lamp module 50 emits light when a switch has established electrical connectivity between a load terminal and the corresponding line terminal, resulting in a load being electrically energized.

In an alternate embodiment, the electrical control circuit 58 can be configured to cause the emitted light to blink. Alternatively, the electrical control circuit 58 can be configured to negate the emission of light, for example, lamp module 50, operating as a ground presence indicator, is reconfigured to emit light when power has been coupled to wiring device 10 but a ground conductor is not electrically connected to the ground terminal of wiring device 10.

Figure 3:
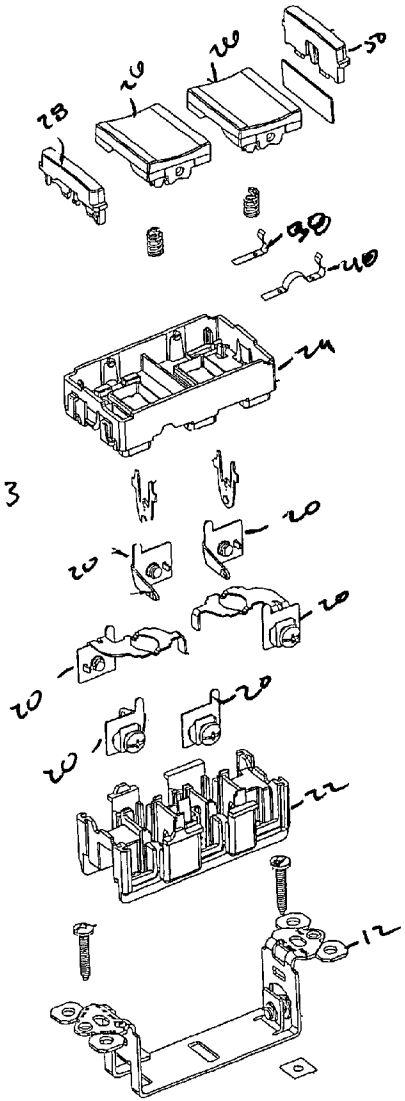
FIG. 3 is an exploded view of an alternative embodiment of the electrical device shown in FIG. 1.

In an alternative embodiment, as shown in FIG. 3, the electrical device 10 of the present invention includes a three way switch, a single pole switch and a lamp module. The embodiment shown in FIG. 3 is substantially similar to the embodiment shown in FIG. 2 with the exception that one of the single pole switches has been replaced by a three way switch.

Figure 4:
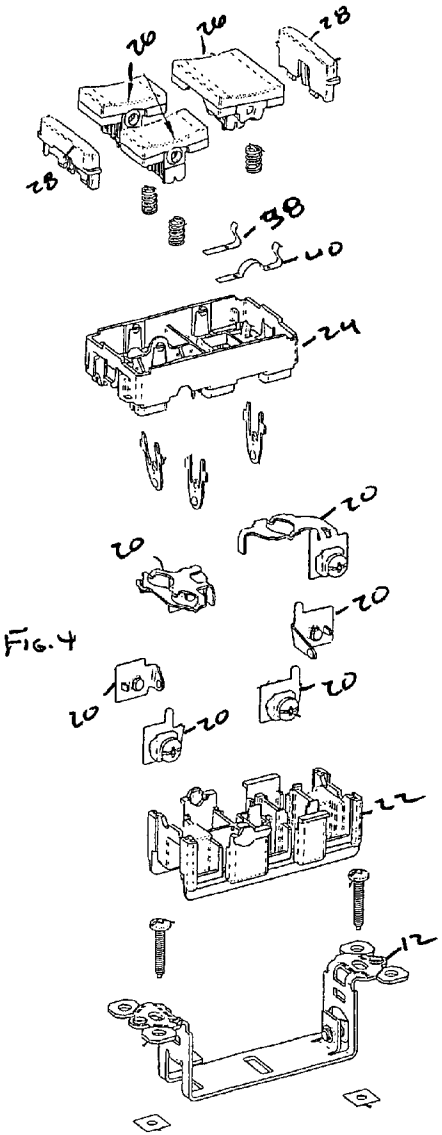
FIG. 4 is an exploded view of an alternative embodiment of the electrical device shown in FIG. 1.

In an alternative embodiment, as shown in FIG. 4, the electrical device 10 of the present invention includes a dual single pole switch unit and three way switch. The embodiment shown in FIG. 4 is substantially similar to the embodiment shown in FIG. 3 with the exception that the single pole switch has been replaced by a dual single pole switch unit.

Figure 5:
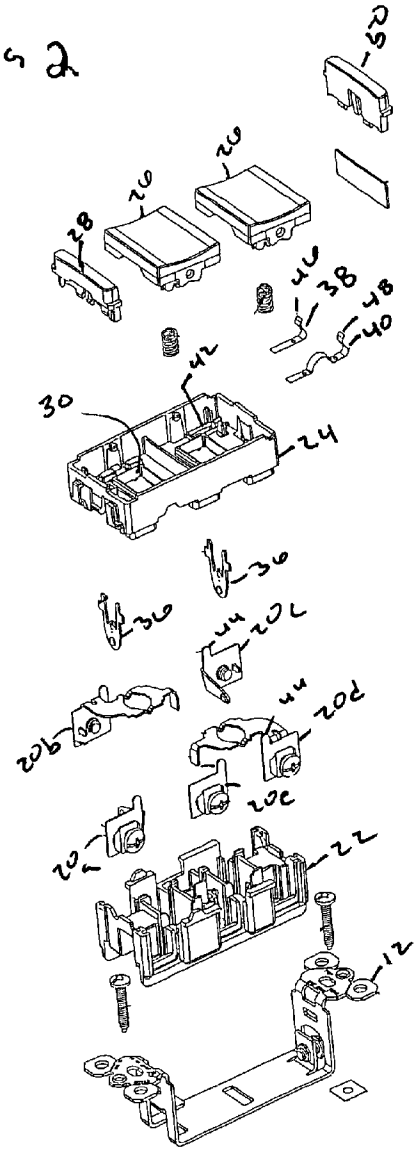
FIG. 5 is an exploded view of an alternative embodiment of the electrical device shown in FIG. 1.
Figure 5:
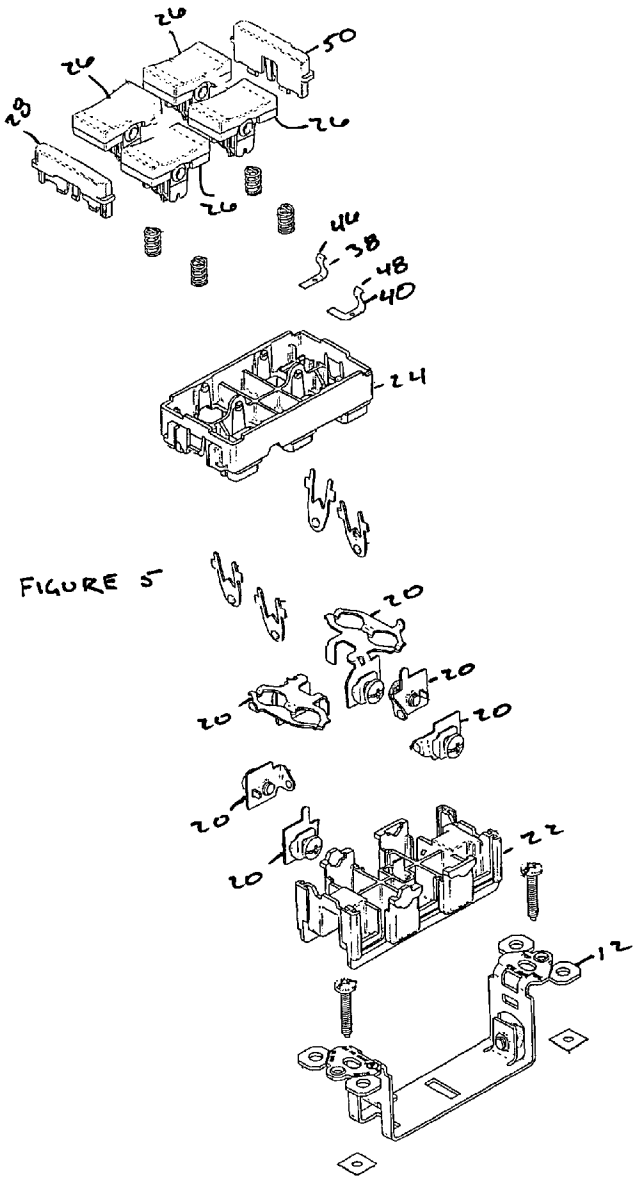
Figure 8:
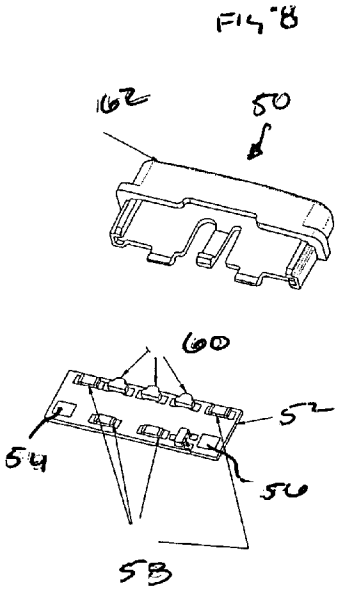
FIG. 8 is a perspective view of a lamp module of the present invention.

In an alternative embodiment, as shown in FIG. 5, the electrical device 10 of the present invention includes two dual single pole switch units and is further configured for the installation of a removable lamp module. The embodiment shown in FIG. 5 is substantially similar to the embodiment shown in FIG. 4 with the exception that the three way switch has been replaced by a second dual single pole switch unit.

Figure 6:
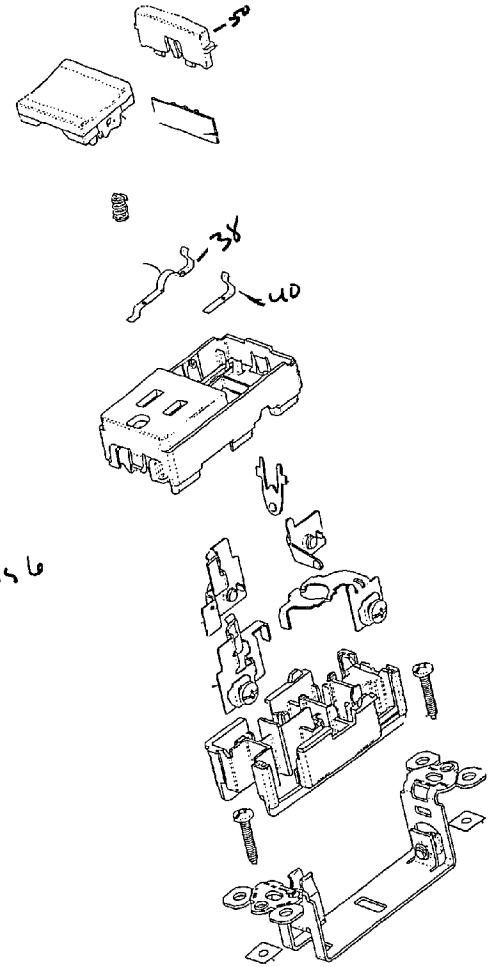
FIG. 6 is an exploded view of an alternative embodiment of the electrical device shown in FIG. 1.

In an alternative embodiment, as shown in FIG. 6, the electrical device 10 of the present invention includes a single pole switch, a receptacle and a lamp module. The embodiment shown in FIG. 6 is substantially similar to the embodiment shown in FIG. 2 with the exception that one single pole switch is replaced by a receptacle.

In an alternative embodiment, as shown in FIG. 7, the electrical device 10 of the present invention includes a dual single pole switch unit, a receptacle and a lamp module. The embodiment shown in FIG. 7 is substantially similar to the embodiment shown in FIG. 6 with the exception that the single pole switch is replaced by a dual single pole switch unit.

It will be apparent to those skilled in the art that other desirable alternative embodiments of the present invention are readily constructed from the teachings contained herein, for example other alternative embodiments may include ground fault interruption and/or arc fault circuit interrupter protection.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

I claim:

1. An electrical wiring device for use in an electric circuit, the device comprising: a device housing;

at least one switch disposed within the device housing, the at least one switch including at least one terminal member configured to be coupled to the electric circuit;

a lamp receptacle formed in the device housing, the module receptacle including a contact element that is electrically coupled to the at least one terminal member; and a lamp module including at least one contact member and a light emitting element, the lamp module being configured to be inserted into the lamp receptacle such that the circuit contact member engages the contact element to thereby establish electrical connectivity between the lamp module and the at least one terminal member, the lamp module also being removable from the lamp receptacle to thereby disengage the at least one circuit contact member from the contact element, the lamp module including a circuit, the circuit being a power-on circuit configured to light the light emitting element if power is supplied to the electric circuit, or the circuit being a device locator circuit configured to light the light emitting element if the at least one switch is in an open state, or the circuit being a pilot light circuit configured to light the light emitting element if the at least one switch is energized and in a closed state.

2. The electrical wiring device of claim 1, further including a blank module having a blank module form factor that is similar to the lamp module form factor such that the blank module is insertable into the lamp receptacle when the lamp module is not inserted in the lamp receptacle.

3. The electrical wiring device of claim 1, wherein the lamp module includes:

a housing having a form factor allowing the lamp module to be installed in the electrical device;

a printed circuit board disposed in the housing, the printed circuit board having disposed thereon lamp circuitry, the lamp circuitry including at least one light emitting diode and the at least one circuit contact member for engaging complementary electrical terminals of the electrical device; and a lens portion disposed on the housing over the least one light emitting diode.

4. The electrical wiring device of claim 3, wherein the printed circuit board further includes a blinker circuit disposed thereon.

5. The electrical wiring device of claim 3, wherein the printed circuit board further includes a negation circuit disposed thereon.

6. The electrical wiring device of claim 1, the at least one switch comprising: at least a second terminal member, a switch actuator, in which the switch actuator is configured for establishing or breaking electrical connectivity between the at least one terminal member and the at least second terminal member.

7. The electrical wiring device of claim 6, wherein the lamp module includes a second contact member, the second contact member coupled electrically to the at least second terminal member.

8. The electrical wiring device of claim 6, wherein the lamp module emits light absent electrical connectivity between the at least one terminal member and the at least second terminal members.

9. The electrical wiring device of claim 7, wherein the lamp module emits light when electrical connectivity between the at least one terminal member and the at least second terminal member is established.

10. The electrical wiring device of claim 1, wherein the lamp module emits light if the electrical wiring device is coupled to the electric circuit.

11. A method for installing an electrical wiring device in an electric circuit, the method comprising:

providing an electrical wiring device including a device housing and at least one switch disposed within the device housing, the at least one switch including at least one terminal member configured to be coupled to the electric circuit, the wiring device also including a lamp receptacle formed in the device housing, the lamp receptacle including a contact element that is electrically coupled to the at least one terminal member;

providing a lamp module configured to be inserted into the lamp receptacle, the lamp module including a circuit contact member, the circuit contact member being configured to engage the contact element to establish electrical connectivity between the lamp module and the at least one terminal member; and inserting the lamp module into the lamp receptacle such that the circuit contact member engages the contact element to thereby establish electrical connectivity between the lamp module and the at least one terminal member.

12. The method of claim 11, further comprising the step of removing the lamp module from the lamp receptacle to thereby disengage the at least one circuit contact member from the contact element.

13. The method of claim 11, further comprising the step of coupling the electrical wiring device to the electric circuit to provide electrical power to the electrical wiring device, wherein the lamp module provides a predetermined amount of illumination.

14. The method of claim 11, further comprising the step of providing a non-light emitting blank module having a blank module form factor substantially identical to the lamp module form factor such that the blank module is insertable into the lamp receptacle when the lamp module is not inserted in the lamp receptacle.

15. The method of claim 14, further comprising the steps of:

removing the lamp module from the lamp receptacle; and inserting the non-light emitting blank module into the lamp receptacle.

16. The method of claim 15, further comprising the steps of:

removing the non-light emitting blank module from the lamp receptacle; and re-inserting the lamp module into the lamp receptacle.

17. A method of making an electrical wiring device for use in an electric circuit, the method comprising:

providing a device housing, the device housing having a lamp receptacle formed therein, the lamp receptacle including a receptacle contact element;

disposing at least one wiring device within the device housing, the at least one wiring device including at least one switch, the at least one switch including at least one terminal member configured to be coupled to the electric circuit, the at least one terminal member also being configured to engage the receptacle contact element when the at least one wiring device is disposed within the device housing;

providing a lamp module having a form factor that is configured to be inserted into the lamp receptacle, the lamp module including a circuit contact member configured to engage the contact element to establish electrical connectivity between the lamp module and the at least one terminal member; and inserting the lamp module into the lamp receptacle such that the circuit contact member engages the contact element to thereby establish electrical connectivity between the lamp module and the at least one terminal member.

18. The method of claim 17, further comprising the step of providing a non-light emitting blank module having a blank module form factor that is substantially identical to the lamp module form factor such that the blank module is insertable into the lamp receptacle when the lamp module is not inserted in the lamp receptacle.

19. A method of making an electrical wiring device for use in an electric circuit, the method comprising:

providing a device housing, the device housing having a lamp receptacle formed therein, the lamp receptacle including a receptacle contact element;

disposing at least one wiring device within the device housing, the at least one wiring device including at least one switch, the at least one switch including at least one terminal member configured to be coupled to the electric circuit, the at least one terminal member also being configured to engage the receptacle contact element when the at least one wiring device is disposed within the device housing;

providing a non-light emitting blank module having a blank module form factor that is identical to the lamp module form factor such that the blank module is insertable into the lamp receptacle when the lamp module is not inserted in the lamp receptacle; and inserting the blank module into the lamp receptacle.

20. The method of claim 19, further comprising the step of providing a lamp module, the lamp module having a circuit contact member, the circuit contact member engaging the contact element to establish electrical connectivity between the lamp module and the at least one terminal member, the lamp module having a form factor such that the lamp module is insertable into the lamp receptacle when the blank module is not inserted in the lamp receptacle.

* * * * *

UNITED STATES PATENT AND TRADEMARK OFFICE

CERTIFICATE OF CORRECTION

PATENT NO. : 7,213,932 B1
APPLICATION NO. : 10/726173
DATED : May 8, 2007
INVENTOR(S) : Gerald R. Savicki, Jr.

It is certified that error appears in the above-identified patent and that said Letters Patent is hereby corrected as shown below:

On Title Page

Item 75

Appears as: Inventor: Gerald R. Savicki, Jr., Syracuse, NY (US)

Should be: Inventor: Gerald R. Savicki, Jr., Canastota, NY (US)

Item 73

Appears as: Assignee: Pass & Seymour, Inc., Syracuse, CA (US)

Should be: Assignee: Pass & Seymour, Inc., Syracuse, NY (US)

Signed and Sealed this

Tenth Day of July, 2007

JON W. DUDAS
*Director of the United States Patent and Trademark Office*